US005782293A

United States Patent [19]

Sather

[11] Patent Number: 5,782,293

[45] Date of Patent: Jul. 21, 1998

[54] HEAT EXCHANGER FOR A PULP DRYER

[76] Inventor: Stanley H. Sather, 894 Citadel Drive, Port Coquitlam, British Columbia, Canada, V3C 5Y1

[21] Appl. No.: 547,221

[22] Filed: Oct. 24, 1995

[51] Int. Cl.[6] ..... F28B 1/06

[52] U.S. Cl. ..... 165/110; 165/174; 165/175; 165/134.1

[58] Field of Search ..... 165/110, 145, 165/173, 174, 175, 134.1, 111

[56] References Cited

U.S. PATENT DOCUMENTS

| | | | |
|---|---|---|---|
| 1,925,847 | 9/1933 | Prentice | 165/178 |
| 2,278,086 | 3/1942 | Lea | 165/82 |
| 2,587,720 | 3/1952 | Fritzberg | 165/110 |
| 3,026,092 | 3/1962 | Pellegrini | 165/110 X |
| 4,909,309 | 3/1990 | Palfalvi et al. | 165/110 X |

FOREIGN PATENT DOCUMENTS

| | | | |
|---|---|---|---|
| 2040827 | 10/1992 | Canada | 165/176 |
| 2096262 | 11/1994 | Canada . | |
| 533858 | 2/1941 | United Kingdom | 165/175 |
| 549365 | 11/1942 | United Kingdom | 165/175 |
| 962753 | 7/1964 | United Kingdom | 165/174 |

*Primary Examiner*—Leonard R. Leo
*Attorney, Agent, or Firm*—Norman M. Cameron

[57] ABSTRACT

A steam heat exchanger for a wood pulp dryer. The heat exchanger has a frame and a plurality of tubes extending between the ends of the heat exchanger in parallel, spaced-apart relationship to each other. A plurality of fins is connected to the tubes. There is an outlet header near the bottom of the heat exchanger, the outlet ends of the tubes being connected to the outlet header. There is a steam inlet header near the top of the heat exchanger. In one embodiment the inlet header has an inner conduit with a plurality of openings spaced-apart therein for discharging steam from the inner conduit. There is an outer conduit extending about the inner conduit. The inlet ends of the tubes are connected to the outer conduit. There is a middle conduit between the inner and outer conduit with openings in the top thereof. In another embodiment of the invention the inlet header and outlet header are vertically non-aligned when the frame is vertical. In a further embodiment of the invention there is a diverter conduit between the inlet header and the outlet header which is insulated. In a still further embodiment of the invention the inlet header has an inside bottom. A plurality of tubes have their tops connected to the inlet header above the bottom while one tube for handling contaminants, preferably insulated, is connected flush with the bottom.

17 Claims, 10 Drawing Sheets

HEAT EXCHANGER FOR A PULP DRYER

BACKGROUND OF THE INVENTION

1. Field of the Invention

This invention relates to steam heat exchangers for wood pulp dryers.

2. Description of the Related Art

Pulp dryers are conventionally used to dry wood pulp in sheet form prior to shipment. Heat is applied to the pulp by heating air with heat exchangers, normally heated with steam, and blowing the air against the web of pulp. The type of heat exchanger used on many dryers built after 1980 has a frame with a plurality of spaced-apart, vertical copper tubes extending between opposite ends thereof. The tubes extend tightly through fins, usually of aluminum, which are perpendicular to the tubes. The tops of the tubes are connected to an inlet header which is typically perpendicular to the tubes. The bottoms of the tubes are connected to an outlet header. Steam is conventionally fed into the center of the inlet header by means of a T fitting. However, the life span of such prior art heat exchangers has been less than desirable. In some cases the life expectancy has been approximately 8 years, whereas a life span of 16–20 years is expected by many in the pulp industry. Pulp dryers have many heat exchangers and it is expensive to replace them, both in terms of the cost of the new heat exchangers, the labor required to replace them, and the down time of the pulp dryer needed to carry out this maintenance operation.

The failure of some prior art heat exchangers is believed to be due to a combination of problems including the incorporation of steel components in contact with the steam. In addition, the arrangement of the inlet header appears to cause an uneven distribution of steam in the various tubes of each heat exchanger. The tubes carrying higher steam flow wear faster. Finally, in some mills steam becomes contaminated with chemicals and by-products of the pulp conversion process from time to time, the most common being known as black liquor. This material coats and ultimately corrodes the tubes.

In my earlier Canadian Patent App. No. 2,040,827, laid open Oct. 20, 1992, I disclosed the concept of a steam coil with an inlet header having inner and outer conduits. The inner conduit has openings in the top which allow steam to pass into the space between the inner conduit and outer conduit which is connected to the tubes of the steam coil. Impurities are diverted along the inner conduit to a diverter conduit to reduce possible contamination of the tubes with black liquor or other contaminants. The openings in the top of the inner conduit are louvered or tear-drop shaped which increases the costs of the inlet header.

The diverter conduit in my earlier published Canadian application is exposed to cooling by the pulp dryer fans. Under some circumstances this may cause black liquor to condense in the diverter conduit or the steam and condensate headers, eventually building up a solid deposit in the conduit and plugging it.

Another problem associated with prior art steam coils is the fact that the inlet headers and outlet headers are conventionally aligned in a vertical plane. The fittings of one coil therefore interfere with another coil above, making it necessary to provide a substantial vertical space between adjacent coils. This space reduces the effective area of the coils. If it could be reduced or eliminated, then the tubes of the coils could be longer and more fins added which would increase the total efficiency of the dryer.

Furthermore the coils often have channel-like members on the tops and bottoms which tend to lock together when a coil is lowered onto the one below. This makes installation and removal of coils more difficult than desirable.

SUMMARY OF THE INVENTION

It is an object of the invention to provide an improved steam coil which can be built and sold at a competitive price and which is rugged and reliable in construction.

It is another object of the invention to provide an improved steam coil which resists contamination with black liquor and other contaminants. In particular, it is an object of the invention to provide an improved steam coil with a diverter tube for black liquor and other contaminants which is not subject to condensation of black liquor within the diverter tube.

It is a still further object of the invention to provide an improved steam coil which can be installed with less clearance above and below the coil, whereby the lengths of tubes and numbers of fins on the tubes can be increased compared to prior art steam coils.

In accordance with these objects there is provided a steam heat exchanger for a wood pulp dryer having a first end and a second end which is opposite the first end. There is a plurality of tubes, each having an inlet end and an outlet end, the tubes extending between the ends of the heat exchanger in parallel, spaced-apart relationship to each other. There is an outlet header near the second end of the heat exchanger. The outlet ends of the tubes are connected to the outlet header. There is steam inlet header near the first end of the heat exchanger. The inlet header has an inner conduit with means at a first end thereof for connecting the inner conduit to a source of steam and a plurality of openings spaced-apart therein for discharging steam from the inner conduit. There is a middle conduit extending about the inner conduit which has a top and a plurality of steam openings. There is also an outer conduit which extends about the middle conduit. The ends of the tubes are connected to the outer conduit.

Another aspect of the invention provides a steam heat exchanger for a wood pulp dryer having a frame with a first end and a second end which is opposite the first end. There is a plurality of tubes within the frame. Each tube has an inlet end and outlet end. The tubes extend between the ends of the frame in parallel, spaced-apart relationship to each other. There is an outlet header near the second end of the frame. The outlet ends of the tubes are connected to the outlet header. There is a steam inlet header near the first end of the frame. The inlet header has first means for connecting the heat exchanger to a source of steam. The inlet ends of the tubes are connected to the inlet header. The inlet header and the outlet header are mounted offsetly in the frame, whereby the inlet header and outlet header are vertically non-aligned when the frame is vertical.

There is provided according to a further aspect of the invention a steam heat exchanger for a wood pulp dryer. The heat exchanger has a first end, a second end which is opposite the first end, and a plurality of tubes. Each tube has an inlet end and an outlet end. The tubes extend between the ends of the heat exchanger in parallel, spaced-apart relationship to each other. There is an outlet header near the second end of the heat exchanger. The outlet ends of the tubes are connected to the outlet header. There is a steam inlet header near the first end of the heat exchanger. The inlet header has an inside with a bottom and means at a first end thereof for connecting the inlet header to a source of steam. There is a plurality of openings spaced-apart in the inlet header for discharging steam. The inlet ends of the tubes are connected to the inlet header about the openings. A plurality of the tubes have inlet ends above the bottom of the inside of the inlet header. One said tube has an inlet end which is flush with the bottom.

A still further aspect of the invention provides a steam heat exchanger for a wood pulp dryer having a first end, a second end which is opposite the first end, and a plurality of tubes. Each tube has an inlet end and an outlet end. The tubes extend between the ends of the heat exchanger in parallel, spaced-apart relationship to each other. There is an outlet header near the second end of the heat exchanger which may be thermally insulated. The outlet ends of the tubes are connected to the outlet header. There is a steam inlet header near the first end of the heat exchanger having a first end, a second end, means at the first end thereof for connecting the inlet header to a source of steam and a plurality of openings spaced-apart therein for discharging steam. The inlet ends of the tubes are connected to the inlet header about the openings. There is a diverter tube for contaminants in the steam which is connected to the second end of the inlet header and extends to the second end of the heat exchanger. The diverter tube is thermally insulated. Preferably the diverter tube and the headers are covered on both the upstream and downstream sides of the heat exchanger.

The triple-tube construction of the inlet header described in one aspect of the invention above provides an economical structure which, at the same time, is very effective in separating the steam from contaminants such as black liquor.

Offsetting the inlet header with respect to the outlet header allows the space between adjacent heat exchangers to be reduced, thus allowing the lengths of the tubes to be increased and the number of fins to be increased. This increases the effective heat transfer area of the entire pulp dryer.

The alternative construction of the heat exchanger, wherein a plurality of the openings in the inlet header are above the bottom of its inside, and one of the openings is flush with the bottom, means that the tops of most of the tubes are above any contaminants in the bottom of the inlet header. Contaminants flow down the one tube flush with the bottom, thus providing an internal diverter for contaminants instead of requiring a separate, exterior diverter which may be inconvenient in some applications. Insulating the one tube prevents the contaminants from solidifying in the tube which might occur if the tube were cooled by the stream of air from the fan.

Insulating the separate diverter tubes in heat exchangers so equipped also prevents black liquor and other contaminants from solidifying, and ultimately blocking the diverter tubes. The temperature of the tubes is kept above the temperature where solidification may occur. Covering both sides of the inlet header and outlet header, and thus isolating them from the stream of air, and thermally insulating them, also keeps the temperature of these headers above the critical point, further reducing the risk of the coil becoming contaminated and possibly plugged with black liquor.

DESCRIPTION OF THE PREFERRED EMBODIMENTS

Figure 1:
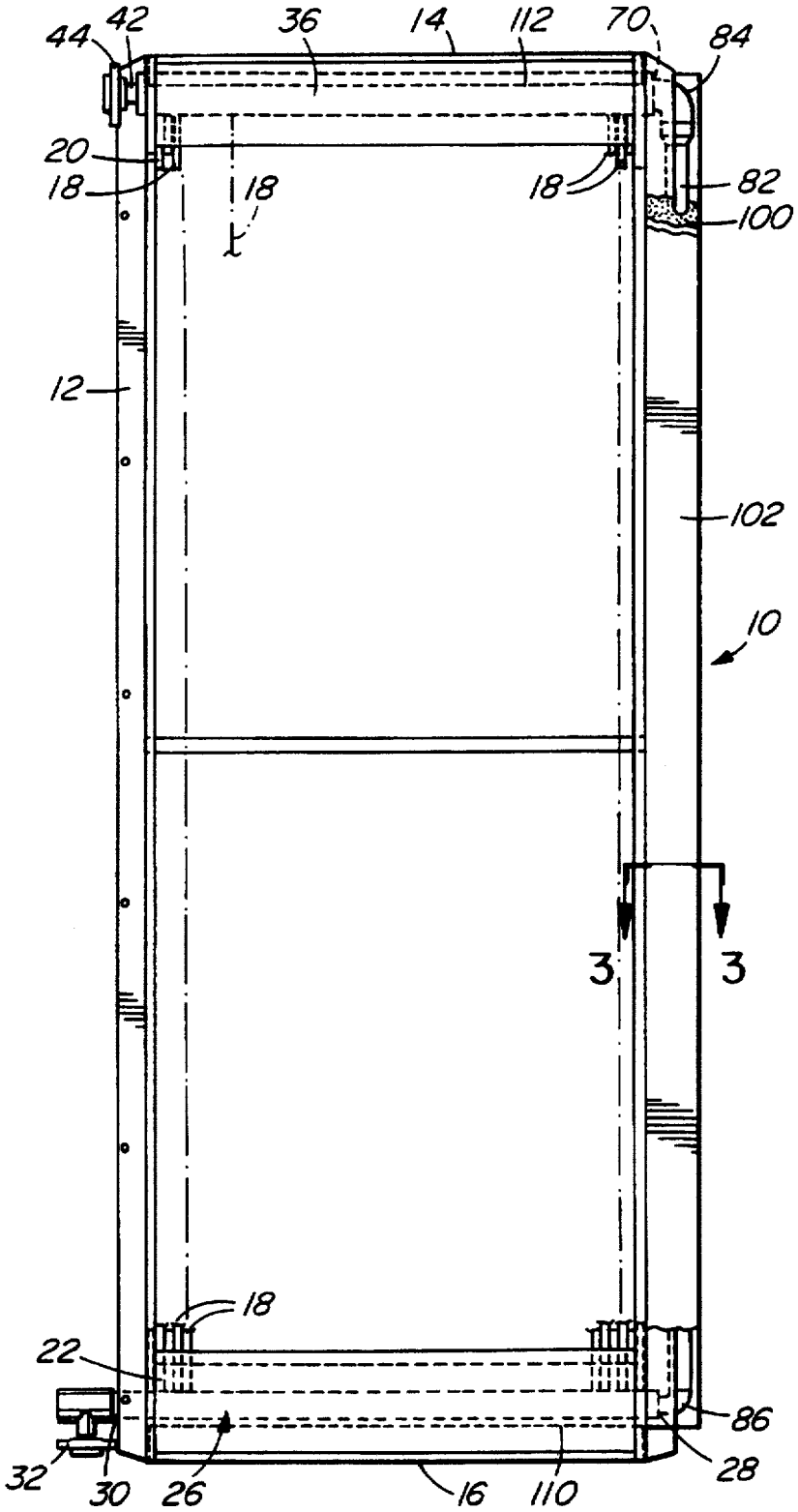
FIG. 1 is a simplified front elevation of a heat exchanger according to an embodiment of the invention with the tubes thereof and the cover and insulation for the diverter tube being shown in fragment.
Figure 9:
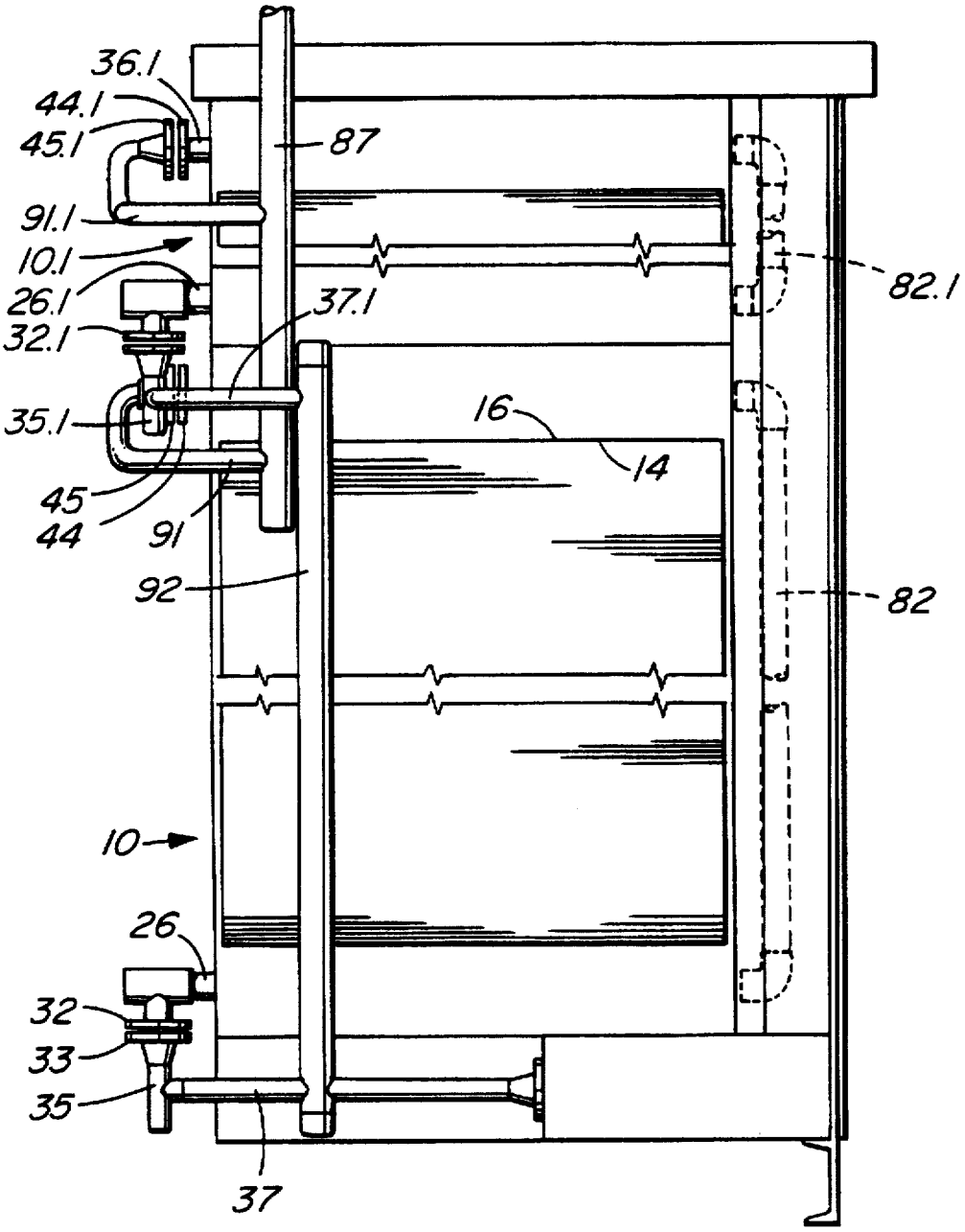
FIG. 9 is a front elevation of a typical installation of heat exchangers.
Figure 10:
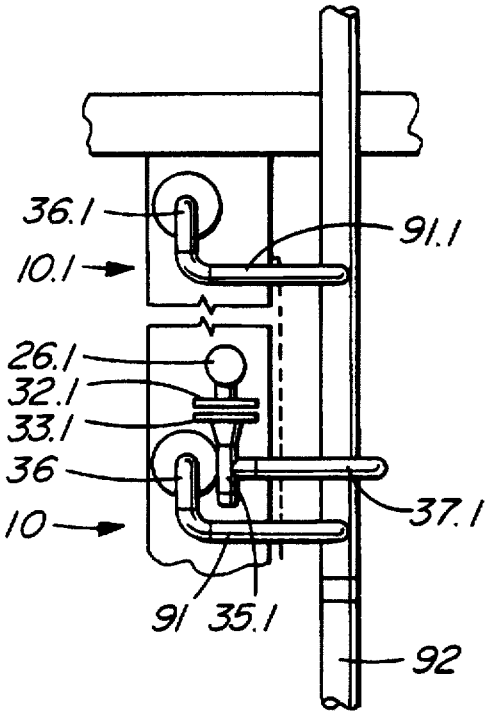
FIG. 10 is a fragmentary side elevation thereof.
Figure 11:
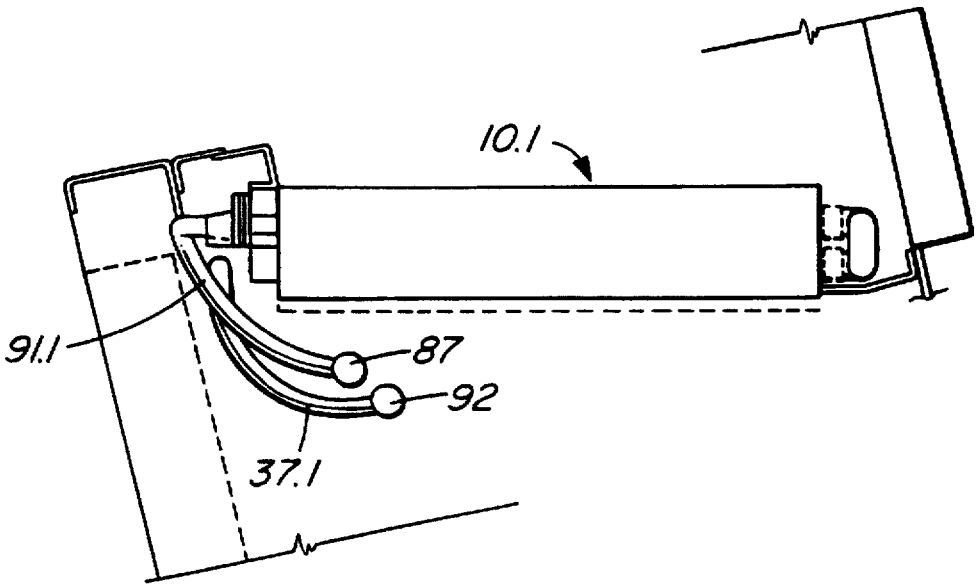
FIG. 11 is a top plan thereof.

Referring to FIG. 1, this shows a steam heat exchanger 10, commonly known as a "steam coil". It has a perimeter frame 12 made of galvanized steel in this example, though other materials could be used. The heat exchanger has a first end 14, which is at the top when the heat exchanger is positioned for use, and a second end 16, which is at the bottom in use. FIG. 9–11 show an installation of two heat exchangers 10 and 10.1. Like parts for exchanger 10.1 have like numbers with the addition of "0.1".

Figure 4:
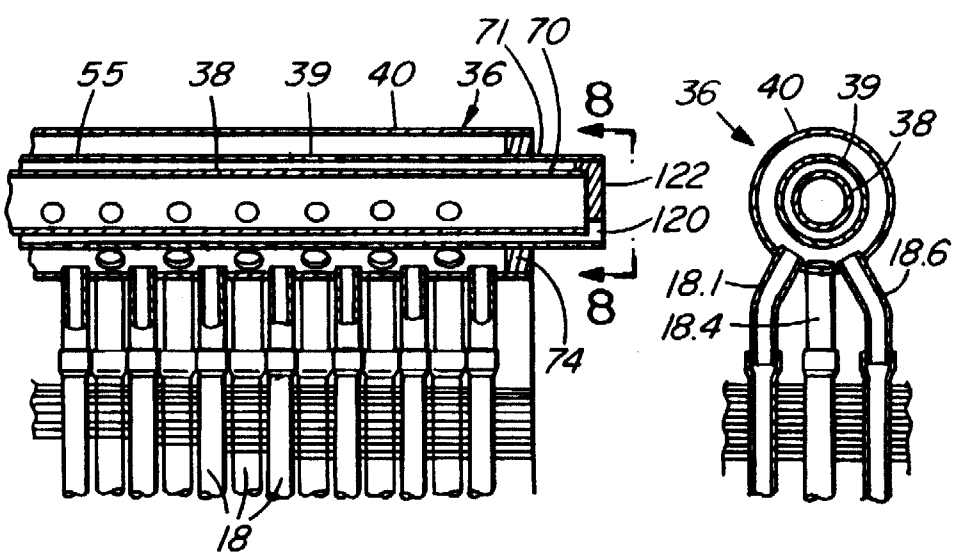
FIG. 4 is a fragmentary, sectional view showing the inlet header thereof, the tops of the tubes thereof and the uppermost fins thereof.

Referring to FIGS. 1 and 4, each heat exchanger has a plurality of tubes 18 which extend between the ends of the heat exchanger in parallel, spaced-apart relationship to each other. Referring to the tube 18 which is furthest to the left in FIG. 1, it has an inlet end 20 and an outlet end 22. The other tubes are identical. The tubes are all of copper in this example although other metals could be substituted. Copper is preferred because of its heat transfer abilities. Silver brazing is used to connect the components of the heat exchanger in this example.

There is a plurality of fins 24 fitted about the tubes and which extend perpendicularly thereto as seen in FIG. 4. Only a few of the fins are shown, but the entire area between the ends of the tubes would normally be filled with spaced-apart fins. The fins in this example are of aluminum which is preferred because of its high rate of heat transfer as well as its economy. However, other metals could be used.

Heat exchanger 10 has an outlet header 26 near the second end 16 of the heat exchanger. The outlet header is a straight, elongated pipe which extends perpendicular to the tubes 18.

The outlet header is of copper in this example, though other metals could be used. The outlet ends 22 of the tubes 18 are connected to the outlet header. The outlet header has a first end 28 and a second end 30. The outlet header is sloped slightly towards end 30 to drain condensate. There is a fitting 32 on the second end which allows the outlet header to be connected to a condensate return line. For example, fitting 32.1 of heat exchanger 10.1 in FIG. 9 and 10 is connected to condensate return line 92. An orifice plate (not shown) is placed between fitting 32.1 and the corresponding flange on the condensate return line to hold back the steam so it condenses in the heat exchanger instead of rushing through.

Heat exchanger 10 also includes a steam inlet header 36 near first end 14. This header is elongated and perpendicular to tubes 18. The tubes are connected to this header which supplies steam to the tubes.

Figure 5:
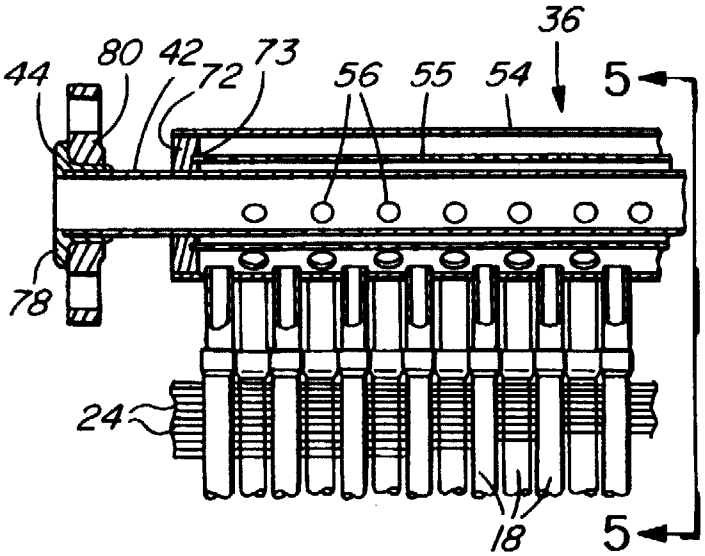
FIG. 5 is a sectional view along line 5—5 of FIG. 4.
Figure 7:
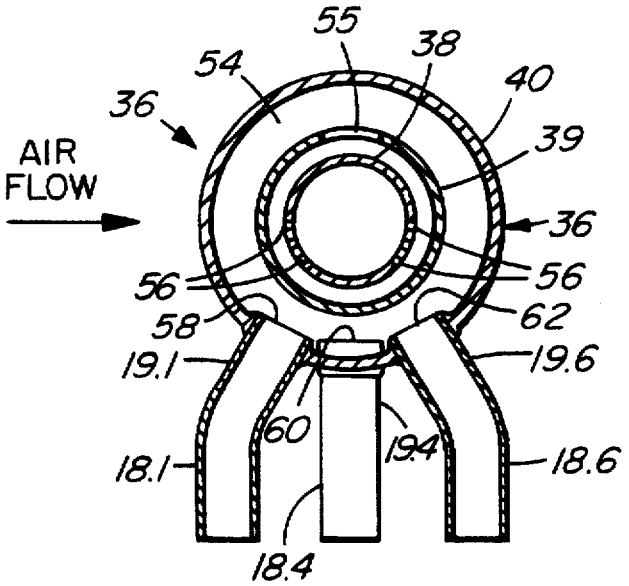
FIG. 7 is an enlarged sectional view of the inlet header and tops of the tubes of the heat exchanger.

As described thus far, heat exchanger 10 is generally conventional. However, this heat exchanger includes a number of improvements over the prior art. One of these improvements relates to the configuration of inlet header 36 which, in the prior art, is typically a single length of pipe with a T fitting at the center thereof which is connected to a source of steam. Instead, inlet header 36 in this embodiment of the invention is comprised of an inner conduit 38 which is located within an middle conduit 39. In turn conduit 39 is located within an outer conduit 40 as seen in FIGS. 4, 5 and 7. In the illustrated embodiment, all the conduits are straight, elongated tubes which are generally co-extensive in the axial direction although the inner conduit is somewhat longer than the other two. The conduits are sufficiently long to extend between the outermost tubes 18 of the heat exchanger. In the illustrated embodiment the inner conduit is a pipe with a smaller diameter than the middle conduit and is radially spaced-apart therefrom. Likewise the middle conduit has a smaller diameter than the outer conduit and is radially spaced-apart therefrom. In this example the conduits are concentric, though this is not essential. In this example the conduits are of copper, which is the preferred material.

Inner conduit 38 has a first end 42 and a second end 70. A flange 44 at the first end is used to connect the inner conduit to a source of steam, such as steam pipe 87 shown for heat exchangers 10 and 10.1 in FIG. 9–11.

The inner conduit 38 has a series of openings 56. In this preferred example the openings are circular and are spaced-apart along the conduit below its center line on each side thereof as seen in FIG. 4 and 7.

As seen in FIG. 4, annular members 72 and 74 are located at opposite ends of outer conduit 40 of the inlet header. Member 72 is sealingly connected to end 73 of the middle conduit 39. Likewise member 74 is sealingly connected to the middle conduit near end 71 thereof. Therefore, space 54 between the middle conduit and the outer conduit is sealed, apart from a plurality of openings 55 in the top of the middle conduit and a plurality of openings 58, 60 and 62 in the outer conduit 40 near its bottom as shown in FIG. 7.

Figure 6:
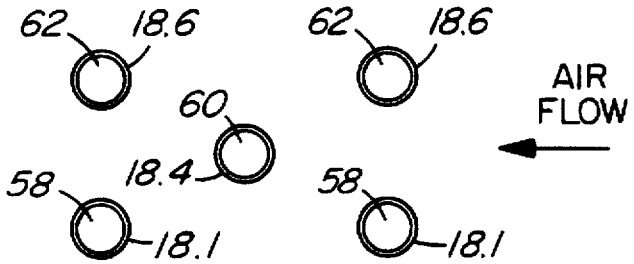
FIG. 6 is a diagram showing the arrangement of apertures in the outer conduit of the inlet header.

As shown in FIGS. 4, 5 and 7, three rows of tubes 18, namely rows 18.1, 18.4 and 18.6 are fitted to the inlet header. Each of the tubes in row 18.1 has an upper portion 19.1 which is angled slightly, approximately 25° in this embodiment, to fit within one of openings 58 in the outer conduit. Tubes 18.6 on the other side are angled a similar amount in the opposite direction from the vertical so their upper portions 19.6 fit within openings 62 in the outer conduit. Tubes 18.4 are straight and fit within openings 60. Openings 62 and 58 are staggered with respect to openings 60, as seen in FIG. 6, to better expose the tubes to the flow of air. This increases the efficiency of the heat exchanger.

The connections of the tubes to the outlet header are similar to those illustrated for the inlet header in FIG. 5 and FIG. 7, but inverted. Also the outlet header is a single tube in this example with no inner or middle conduits.

Heat exchanger 10 is constructed so that all of the components in contact with steam are of copper. Again, it is not essential that all components be made of copper, but it is preferred for the reasons specified above. Referring to FIG. 4, flange 44 therefore has a copper lap ring 78 forming the inner portion thereof. This lap ring is fitted within an annular lap joint flange 80 which can be constructed of a stronger material, forged steel in this particular embodiment. Other connectors could be substituted.

Figure 2:
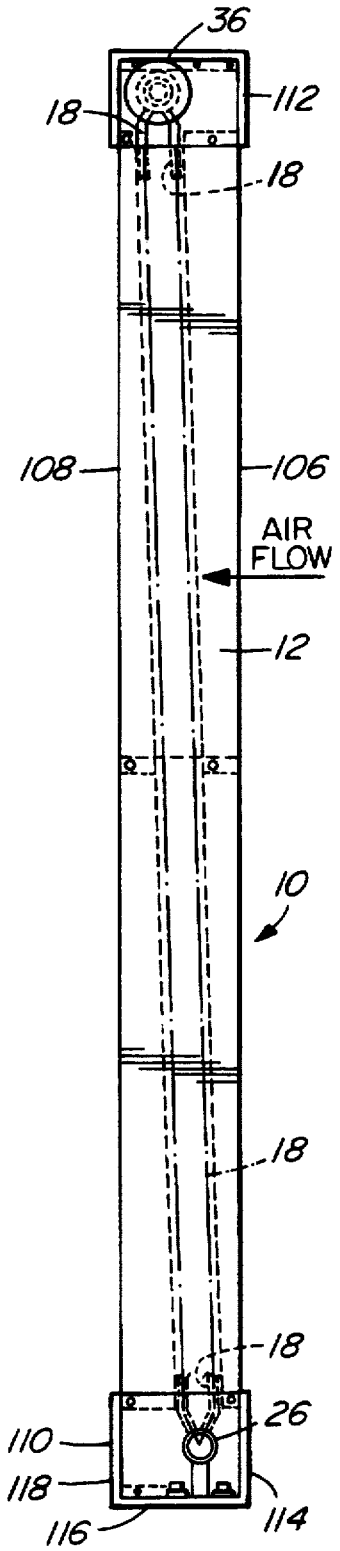
FIG. 2 is a side elevation thereof.

Referring to FIG. 2, the heat exchanger 10 is illustrated in the normal position in which it is installed, namely vertically. It will be appreciated that the inlet header 36 is mounted offsetly in the frame 12 with respect to the outlet header 26. In other words, the inlet header and the outlet header are vertically non-aligned when the frame is vertical as shown. In this embodiment the tubes 18 are slightly sloped at an acute angle with respect to the vertical due to this non-alignment of the inlet and outlet headers.

The benefits of this non-alignment are apparent when the heat exchangers are installed in a typical pulp dryer as illustrated in FIG. 9–10. Heat exchanger 10 is illustrated with an identical heat exchanger 10.1 shown in fragment above.

Referring back to FIG. 1, heat exchanger 1 has a diverter tube or diverter conduit 82 which connects the inner conduit 38 and middle conduit 39 of the inlet header 36 to the outlet header 26. In this particular example, the diverter tube 82 is substantially vertical, being slightly sloped in the manner of the tubes 18 because of the offset headers. Tube 82 is connected to second end 70 of inner conduit 38, second end 71 of middle conduit 39 by elbow 84 and to first end 28 of the outlet header 26 by elbow 86. Like the other components in contact with live steam, the tube 82 and the elbows are made of copper in this example as is preferred.

Steam for the coils is provided by a steam pipe 87, shown in FIG. 9–11, which is oriented vertically in this installation. There is also a condensate pipe 92 to carry away condensate. It also carries black liquor and other contaminants away from the heat exchangers. Curved conduits 91 and 91.1 connect the steam pipe 87 to the inlet headers 36 and 36.1 of the heat exchangers 10 and 10.1. The conduits 91 and 91.1 have flanges 45 and 45.1 respectively which are connected to flanges 44 and 44.1 of the inlet headers. The pipes 87 and 92 could alternatively be located like pipes 220 and 222 in FIG. 16, described more fully below.

Likewise, curved conduits 37 and 37.1 connect the outlet headers of the coils 10 and 10.1 to the condensate pipe 92. These conduits are provided with T-fittings 35 and 35.1 and flanges 33 and 33.1 which are connected to flanges 32 and 32.1 of the outlet headers respectively. As seen best in FIG. 10, the fact that the headers are offset, particularly outlet header 26.1 of heat exchanger 10.1 and inlet header 36 of heat exchanger 10, allows the fittings connected to the headers to overlap in a vertical direction. It may be seen that the T-fitting 35.1 actually extends below the inlet header 36 of heat exchanger 10. Thereby the heat exchangers can be effectively stacked on top of each other without any substantial spacing. The effective lengths of the tubes can be increased along with the number of fins, thus increasing the total efficiency of the pulp dryer.

Figure 3:
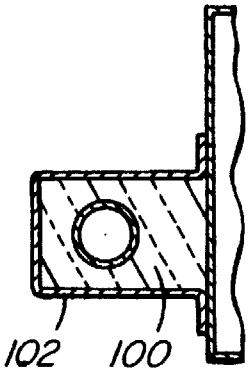
FIG. 3 is a sectional view along line 3—3 of FIG. 1.

As seen best in FIG. 1 and 3, diverter tubes 82 are insulated by insulation 100 extending thereabout along the length of each tube. The purpose of this insulation, of rock wool or glass fiber in this embodiment, is to prevent the diverter tube 82 from being cooled by air blowing through the coil. This effectively eliminates the chance that impurities such as black liquor will harden in the tube 82 and thereby eventually plug it up. In this embodiment the insulation is covered by a channel-shaped housing 102 extending about the insulation and connected to the frame 12 of the heat exchanger.

In this embodiment the inlet header 36 and the outlet header 26 are covered on both upstream side 106 and downstream side 108 of the heat exchanger, these sides being shown in FIG. 2. Housings 110 and 112 extend about the exposed sides of the headers to protect them from the stream of air. For example, housing 110 has an upstream side 114, a bottom 116 and a downstream side 118 covering the outlet header. Housing 112 is similar, but covers the top instead of the bottom of the inlet header. The headers may be thermally insulated inside the housing as shown for the embodiment of FIG. 17 described below.

Figure 8:
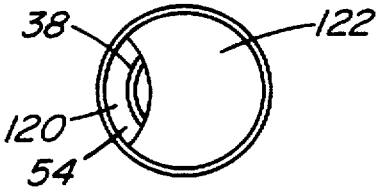
FIG. 8 is a sectional view along line 8—8 of FIG. 4.

The flow of material through the diverter tube 82 is expedited by aperture or orifice 120 in the bottom of orifice plate or baffle 122 of the inlet header as shown in FIG. 4 and 8. The orifice is large enough to expose a portion of the space 54 between the middle conduit and the inside of the inner conduit 38. The orifice plate is provided at the outlet end of the inlet header in this embodiment, but may alternatively be located, for example, in elbow 86 at the inlet end of the outlet header illustrated in FIG. 1.

Figure 12:
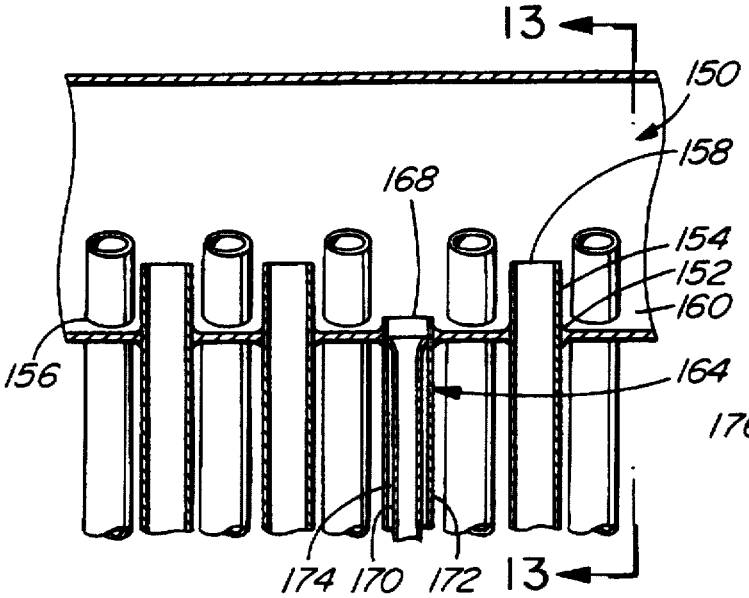
FIG. 12 is a sectional view, similar to FIG. 4, showing an inlet header according to an alternative embodiment of the invention.
Figure 13:
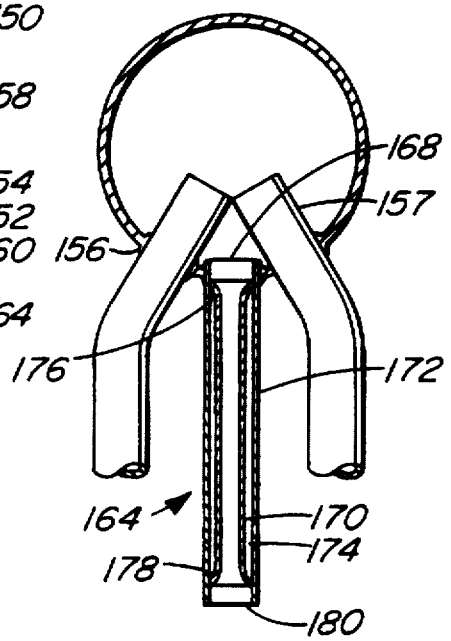
FIG. 13 is a sectional view taken along line 13—13 of FIG. 12.

An inlet header 150 according to an alternative embodiment of the invention is shown in FIG. 12 and 13. In this embodiment, the inlet header is a single tube having a plurality of openings 152 spaced-apart along the bottom thereof. Tubes 154 of the middle row, equivalent to tubes 18.4 in FIG. 7, are connected at these openings. There are also openings 156 on each side of the tube above the bottom which are equivalent to openings 58 and 62 in FIG. 7. Tubes 157 similar to those in rows 18.1 and 18.6 in FIG. 7 are connected to the openings 156.

It may be observed however that the tubes 154 in the center row have inlet ends 158 which are above bottom 160 of the inside of the inlet header. Also it may be observed that the inlet ends of the tubes connected to the openings 156 are also above the bottom of the inside of the inlet header.

However there is one tube 164, shown sixth from the left in FIG. 12, which has an inlet end 168 flush with the bottom 160 of the inside of the inlet header. In this particular example tube 164 is insulated, having an inner tubular member 170 and outer tubular member 172 separated by an air space 174 to insulate the inner tubular member. The inner tubular member has flared portions 176 and 178 at opposite ends to connect to the outer tubular member at the inlet end 168 and outlet end 180 of the tube 164.

Because all of the other tubes have inlet ends above the bottom 160 of the inside of the inlet header, they are not subject to contamination by liquid contaminants, such as black liquor, at the bottom of the inlet header. However tube 164 acts as an internal diverter tube, similar in function to tube 82 in FIG. 1. The liquid contaminants flow down the tube 164 due to the fact that its inlet end 168 is flush with the bottom 160 of the inside of the inlet header. The double construction of tube 164 insulates its inside from the flow of air through the heat exchanger, thus preventing contaminants inside the tube from cooling and plugging up the tube. This alternative embodiment is useful in instances where an external diverter tube is impractical or undesirable.

Figure 14:
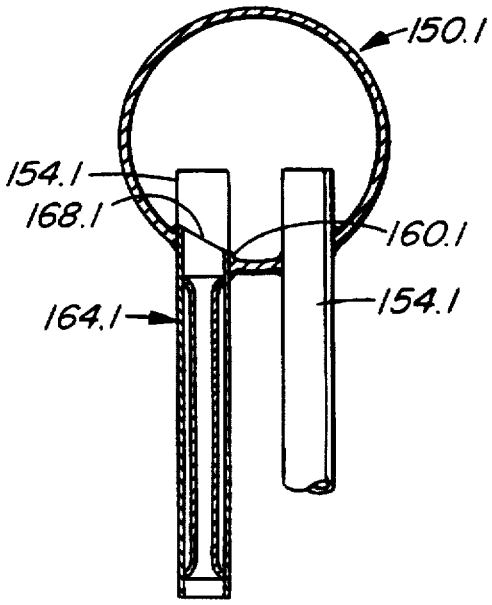
FIG. 14 is a view similar to FIG. 13 of another embodiment.

FIG. 14 shows a variation of the embodiment of FIG. 12 and 13. Here there are only two rows of tubes 154.1 Tube 164.1 in one of the rows has a top 168.1 flush with bottom 160.1 of the header 150.1.

Figure 15:
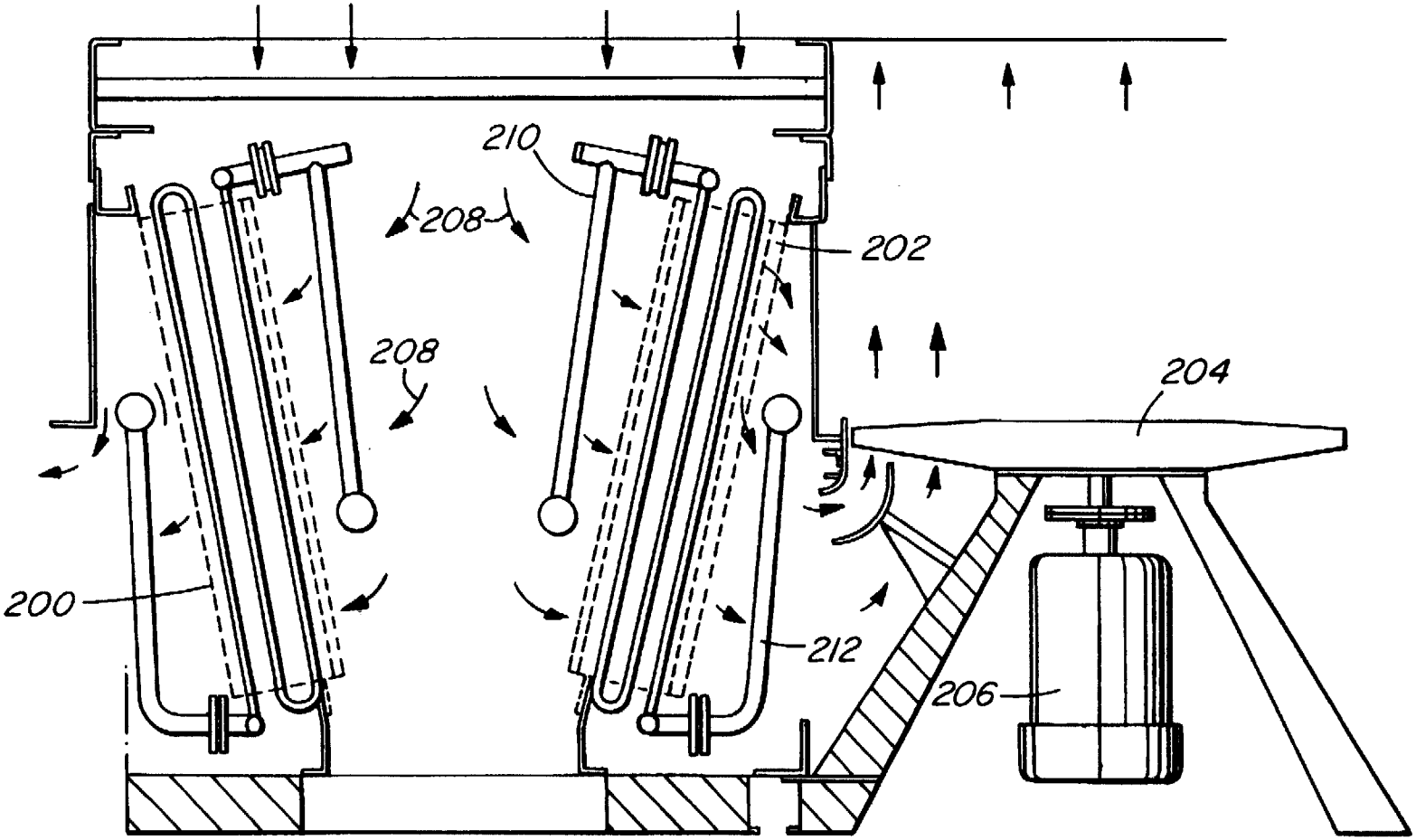
FIG. 15 PRIOR ART
FIG. 15 is a top plan fragmentary view of a prior art heat exchanger installation and adjacent fan.

A typical prior art arrangement of steam coils or heat exchangers 200 and 202 is shown in FIG. 15. A fan 204 driven by a motor 206 drives air in circulation through the heat exchangers as shown by arrows 208. It may be seen how the piping and fittings 210 and 212 on each side of the heat exchangers interfere with, and reduce, the air flow through the heat exchangers.

Figure 16:
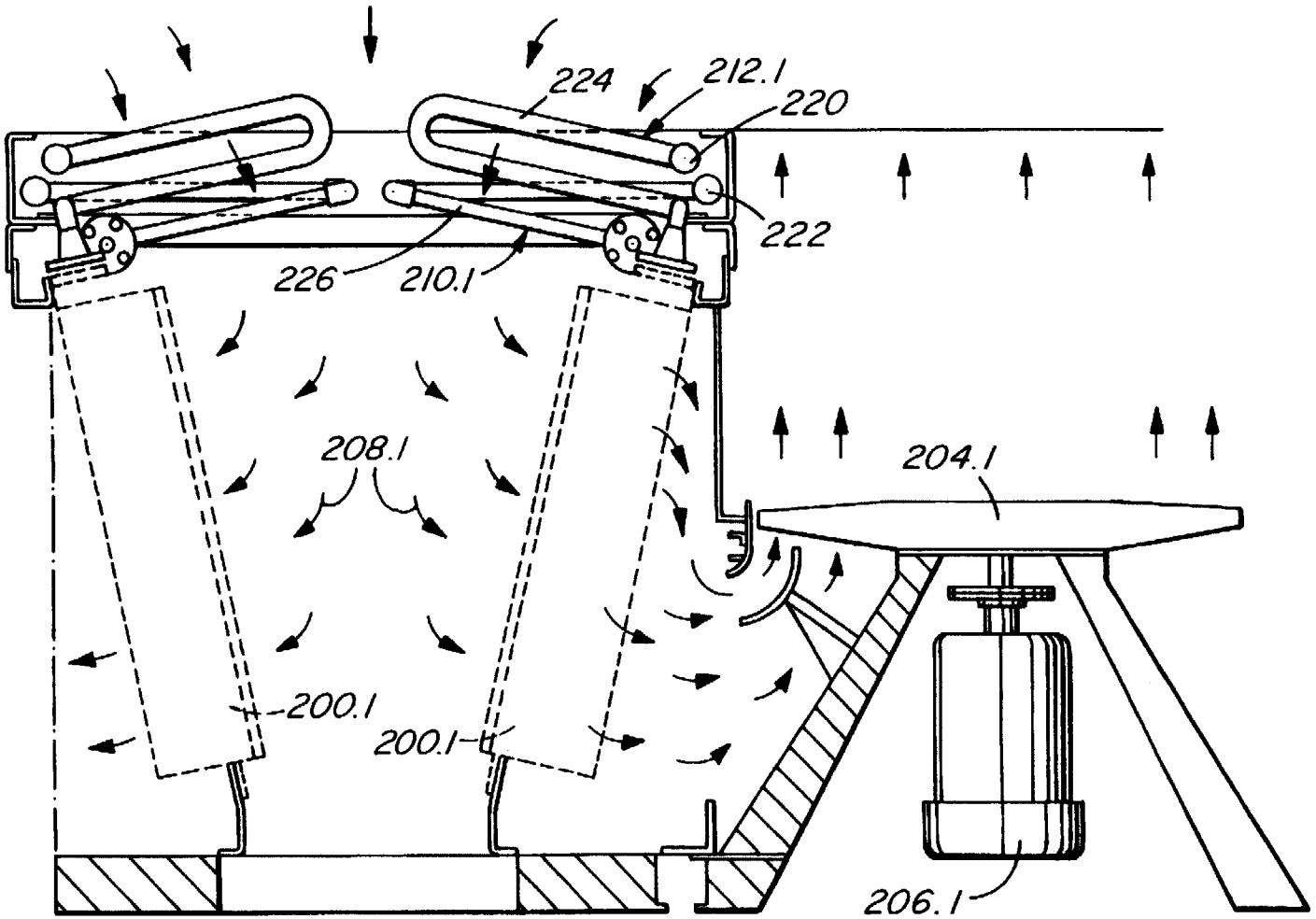
FIG. 16 is a view similar to FIG. 15 of an improved installation according to an embodiment of the invention.

FIG. 16, by comparison, shows an improved arrangement according to the invention where like parts have like numbers to FIG. 15 with the addition of "0.1". The steam piping and fittings 212.1 as well as the condensate piping and fittings 210.1 are well out of the way of the air flow through the heat exchangers. The piping includes a steam pipe 220 and a condensate pipe 222, both of which are vertical in this example. The steam piping includes expansion loop 224 between the steam pipe and each heat exchanger. There is a similar expansion loop 226 between the condensate pipe and the heat exchanger. These accommodate the expansion in the pipes and fittings.

Figure 17:
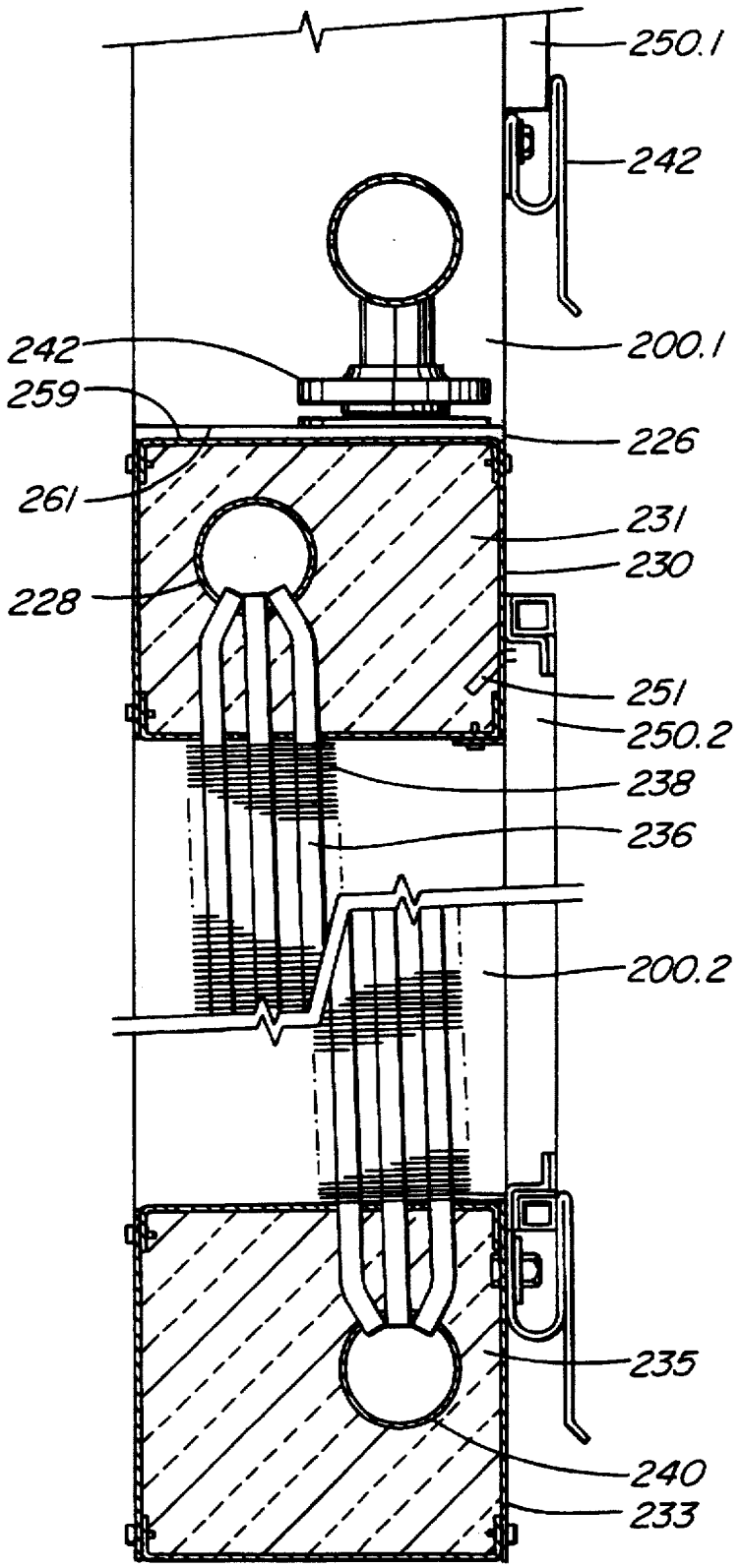
FIG. 17 is a fragmentary side section of a bottom of one heat exchanger according to an embodiment of the invention mounted above another such heat exchanger.
Figure 18:
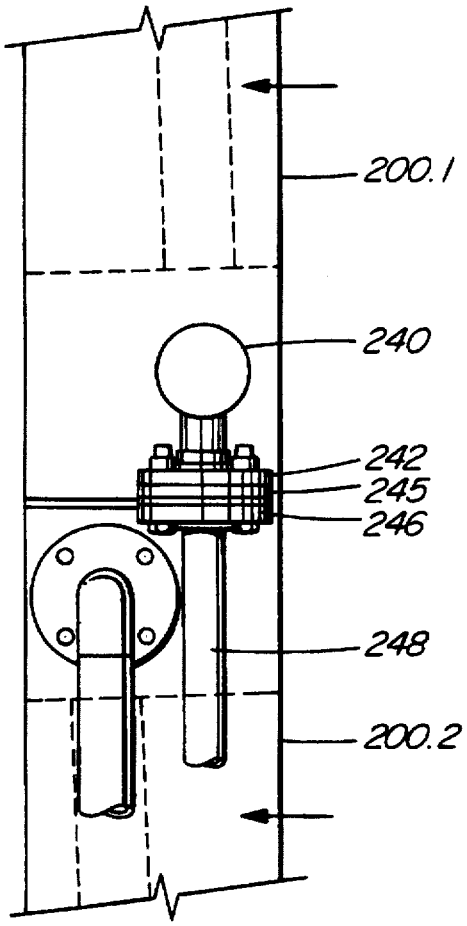
FIG. 18 is a fragmentary side view of the heat exchanger of FIG. 17 and piping connections thereof.
Figure 19:
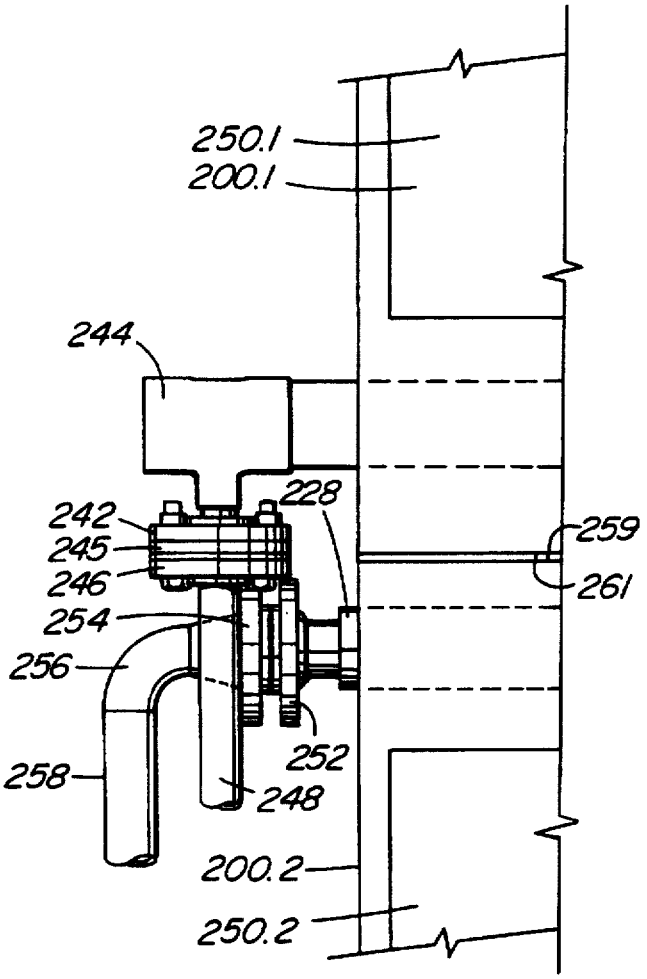
FIG. 19 is a fragmentary front elevation of the heat exchangers and piping of FIG. 18.

Referring to FIG. 17–19, in this embodiment it may be seen that inlet header 228 is boxed in by housing 230 insulated inside by insulation 231. Similarly outlet header 240 is boxed in by housing 233 and insulated by insulation 235. Tubes 236 extend downwardly from the inlet header 228 which is towards one side of the heat exchanger, the left side from the point of view of FIG. 17. The tubes are angled downwardly towards the opposite side of the heat exchanger and have fins 238. The tubes are connected at their bottoms to outlet header 240 provided with a T-fitting 244, used as an elbow, and a horizontal connection flange 242, shown best in FIG. 19. The flange 242 is connected to flange 246 on steam piping 248. There is an orifice plate 245 between the flanges 242 and 246.

FIG. 17 and 19 show heat exchanger 200.1 above described and a similar heat exchanger 200.2 below it. There is a gap, "0.25" (inches) in this example, between them. Inlet header 228 of each heat exchanger is connected to flange 252 which is connected to flange 254 and elbow 256 of condensate piping 258. Flat top 259 of heat exchanger 200.2 and flat bottom 261 of heat exchanger 200.1 allow the heat exchanger above to be supported by the one below during installation and removal without them locking together as occurs with prior art units having vertical flanges or the like on their tops and bottoms.

As seen in FIG. 17 and 19, the heat exchangers 200.1 and 200.2 are equipped with screens 250.1 and 250.2 respectively held in place by a pin 251 at the top of the screen and a U-clip 242 at the bottom.

Operation

In operation, each heat exchanger 10 of FIG. 1 and 2 is oriented vertically with first end 14 at the top. A plurality of such heat exchangers are stacked vertically, one above the other, as shown for heat exchangers 10 and 10.1 in FIG. 9–11. Likewise, a plurality of heat exchangers are arranged side-by-side. Steam enters each heat exchanger 10 through first end 42 of conduit 38 shown in FIG. 4–7. The steam leaves the inner conduit through each of the openings 56. After the steam leaves the inner conduit through the openings, it fills the space between the inner conduit and the middle conduit. The steam then passes out openings 55 of the middle conduit to space 54 between the middle conduit and the outer conduit and enters inlet end 20 of each of the tubes 18 through openings 58, 60 and 62 in the outer conduit shown in FIG. 7. The steam then passes downwardly through the tubes and heats the fins 24. Air blown over the fins is heated before being directed onto the pulp web to dry the pulp. Remaining steam and condensate leaves the outlet end 22 of each tube and enters the outlet header 26 and eventually passes to the condensate return.

Because the openings 55 are in the top of the middle conduit 39, any black liquor or other impurities or condensate entering steam inlet header 36 passes through the middle conduit towards end 70 of the inlet header. Such material then passes through elbow 84, diverter tube 82 and elbow 86 to outlet header 26. Eventually it leaves the heat exchanger and enters the condensate return line, for example return line 92 shown in FIG. 9, where it can be drained off. The other embodiments operate in a similar manner.

It will be understood by someone skilled in the art that many of the details specified above are given by way of example only. Many alternatives and variations are included within the scope of the invention which is to be interpreted with reference to the following claims.

What is claimed is:

1. A steam heat exchanger for a wood pulp dryer, the heat exchanger having a first end, a second end which is opposite the first end, and comprising:

a plurality of tubes, each having an inlet end and an outlet end, the tubes extending between the ends of the heat exchanger in parallel, spaced-apart relationship to each other;

an outlet header near the second end of the heat exchanger, the outlet ends of the tubes being connected to the outlet header; and a steam inlet header near the first end of the heat exchanger, the inlet header having an inner conduit with means at a first end thereof for connecting the inner conduit to a source of steam and a plurality of openings spaced-apart therein for discharging steam from the inner conduit, a middle conduit extending about the inner conduit having a top and a plurality of steam openings, and an outer conduit extending about the middle conduit, the inlet ends of the tubes being connected to the outer conduit.

2. A heat exchanger is claimed in claim 1, wherein the openings in the middle conduit are adjacent the top thereof.

3. A steam heat exchanger as claimed in claim 1, wherein the inner conduit, the middle conduit and the outer conduit are elongated, straight tubes, the outer conduit having a greater cross-sectional extent than the middle conduit and the middle conduit having a greater cross-sectional extent than the inner conduit.

4. A heat exchanger as claimed in claim 3, wherein the inner conduit is radially spaced-apart from the middle conduit and the middle conduit is radially spaced-apart from the outer conduit.

5. A heat exchanger as claimed in claim 4, wherein the inner conduit, the middle conduit and the outer conduit are concentric.

6. A heat exchanger as claimed in claim 5, wherein the inlet header has annular members at each end sealingly connected to the middle conduit and the outer conduit.

7. A heat exchanger as claimed in claim 6, wherein the annular member at the first end is also sealingly connected to the inner conduit.

8. A heat exchanger as claimed in claim 1, further comprising a diverter conduit connecting the inner conduit and the middle conduit to the outlet header.

9. A heat exchanger as claimed in claim 8, wherein the conduits each have a second end which is opposite the first end and the outlet header has a first end and a second end, the diverter conduit extending from the second end of the inner conduit and the second end of the middle conduit to the first end of the outlet header.

10. A heat exchanger as claimed in claim 9, wherein the inlet header has a second end, the heat exchanger further comprising an internal baffle near the second end of the inlet header, the internal baffle having an aperture near the bottom thereof.

11. A heat exchanger as claimed in claim 1, wherein the inner conduit has a bottom, the openings therein being above the bottom to each side thereof.

12. A heat exchanger as claimed in claim 1, wherein the outer conduit has a bottom and a plurality of openings adjacent the bottom, the tubes being connected with said openings of the outer conduit.

13. A heat exchanger as claimed in claim 12, wherein the openings in the outer conduit are in three rows, a first row along the bottom of the outer conduit and second and third rows to each side thereof.

14. A heat exchanger as claimed in claim 13, wherein the tubes connected about the second and third rows of openings have angled tops.

15. A heat exchanger as claimed in claim 13, wherein the openings of the third row are staggered along the outer conduit with respect to the openings of the first row.

16. A steam heat exchanger for a wood pulp dryer, the heat exchanger having a first end, a second end which is opposite the first end, and comprising:

a plurality of tubes, each having an inlet end and an outlet end, the tubes extending between the ends of the heat exchanger in parallel, spaced-apart relationship to each other;

an outlet header near the second end of the heat exchanger, the outlet ends of the tubes being connected to the outlet header;

a steam inlet header near the first end of the heat exchanger having a first end, a second end, means at the first end thereof for connecting the inlet header to a source of steam and a plurality of openings spaced-apart therein for discharging steam, the inlet ends of the tubes being connected to the inlet header with said openings; and a diverter tube for contaminants in the steam connected to the second end of the inlet header and extending to the second end of the heat exchanger, the diverter tube being thermally insulated.

17. A heat exchanger as claimed in claim 16, wherein the heat exchanger has an upstream side and a downstream side relative to air flow therethrough, the headers and the diverter tube being covered on both the upstream side and the downstream side.

* * * * *